US005109254A

United States Patent [19]

Oka et al.

[11] Patent Number: 5,109,254

[45] Date of Patent: Apr. 28, 1992

[54] DEVELOPING APPARATUS

[75] Inventors: Seiji Oka, Yokohama; Tsukuru Kai, Fujisawa; Masaru Tanaka; Tomoji Ishikawa, both of Yokohama, all of Japan

[73] Assignee: Ricoh Company, Ltd., Tokyo, Japan

[21] Appl. No.: 570,799

[22] Filed: Aug. 22, 1990

[30] Foreign Application Priority Data

| | | | |
|---|---|---|---|
| Aug. 25, 1989 | [JP] | Japan | 1-218853 |
| Oct. 17, 1989 | [JP] | Japan | 1-268064 |
| Oct. 18, 1989 | [JP] | Japan | 1-268997 |
| Oct. 20, 1989 | [JP] | Japan | 1-271622 |
| Jul. 4, 1990 | [JP] | Japan | 2-175275 |

[51] Int. Cl.[5] ..... G03G 15/06

[52] U.S. Cl. ..... 355/200; 222/108; 222/DIG. 1

[58] Field of Search ..... 355/210, 245, 260; 222/325, 415, DIG. 1, 108; 118/653, 657, 658

[56] References Cited

U.S. PATENT DOCUMENTS

| | | | |
|---|---|---|---|
| 4,734,737 | 3/1988 | Koichi | 355/246 X |
| 4,742,370 | 5/1988 | Murakami et al. | 355/246 |
| 4,782,360 | 11/1988 | Iwamoto et al. | 355/326 |
| 4,821,075 | 4/1989 | Saito et al. | 355/260 X |
| 4,868,599 | 9/1989 | Niki | 355/260 |
| 4,899,690 | 2/1990 | Hacknauer et al. | 118/653 |
| 4,913,087 | 4/1990 | Saita et al. | 118/653 |
| 4,919,071 | 4/1990 | Gatti | 222/DIG. 1 |
| 4,963,940 | 10/1990 | Nemoto et al. | 355/260 |

*Primary Examiner*—A. T. Grimley
*Assistant Examiner*—Patrick J. Stanzione
*Attorney, Agent, or Firm*—Oblon, Spivak, McClelland, Maier & Neustadt

[57] ABSTRACT

A developing apparatus has a developer cartridge having a first developer storage room for storing an unused new developer, a second developer storage room for storing a used old developer, and shutter members for opening and closing openings of the first and second developer storage rooms; and a device for detachably attaching the developer cartridge to a section for exchanging the old developer for the new developer on a body side of the developing apparatus. The developer cartridge may be attached and detached from the developer exchanging section after deterioration of the developer in use is displayed, and the used developer is collected within the second developer storage room and the new developer is supplied into the developer cartridge after the collection of the used developer. The developer cartridge may be attached to the body of the developing apparatus at any time, and the used developer may be collected within the second developer storage room by operating the developer cartridge by a control signal from the body side of the developing apparatus when life of the developer in use is completed.

22 Claims, 15 Drawing Sheets

DEVELOPING APPARATUS

BACKGROUND OF THE INVENTION

1. Field of the Invention

The present invention relates to a developing apparatus using a developer cartridge to exchange an old developer for anew one.

2. Description of the Related Art

In an image forming apparatus of a so-called electrophotographic type such as a copying machine, a facsimile, a printer, etc., an electrostatic latent image is formed in a latent image carrier. A developing apparatus of a dry type is widely used in such an image forming apparatus. In the developing apparatus using a developer composed of two components such as toner and carrier, the developer is deteriorated with the passage of time so that the quality of an image is reduced. Accordingly, it is necessary to exchange the old developer for a new one. When a developer cartridge is used in this exchange, an exchanging operation is simplified and an operator's hand, etc. do not become dirty with the developer.

In general, an empty developer cartridge is prepared in advance and an used developer is collected within the empty developer cartridge. Thereafter, a new unused developer is supplied into the developing apparatus from another developer cartridge. Accordingly, it is necessary to use two developer cartridges in the exchange of the developers so that the exchanging operation is very complicated.

As mentioned above, in the general developing apparatus, the exchanging operation is complicated and a user cannot exchange the old developer for a new one.

Therefore, the image forming apparatus has a first developer storage room for storing a new unused developer and a second developer storage room for storing an old used developer within one developer cartridge. After the old developer is collected within the second developer storage room, the new developer is supplied into the developing apparatus from the first developer storage room. In this case, it is sufficient to use only one developer cartridge so that the treatment of the developing apparatus is simplified.

When the new developer within the first developer storage room has been supplied onto a body side of the developing apparatus once in the exchange of the developers, developer characteristics such as fluidity are unbalanced since fluidity characteristics of the new unused developer are different from those of the used developer. Accordingly, the developer is deteriorated so that an image has an irregular density in a certain case.

Further, when the exchanging operation of the developers is performed during a copying operation in the image forming apparatus having the above developing apparatus, the copying operation must be interrupted once, thereby wasting time.

After the used developer is collected within the second developer storage room, the new developer is supplied into the body of the developing apparatus from the first developer storage room. A user must await the completion of the collecting and supplying operations of the developers so that wasting time is increased.

The developer within the first developer storage room is controlled with respect to toner density when this developer is forwarded from a factory. Accordingly, the developer has the same volume per unit weight. However, the toner density of the developer discharged from the body of the developing apparatus and collected within the second developer storage room is not necessarily constant.

This is because the density of the developer within the body of the developing apparatus is constantly controlled to perform a developing operation, but is not necessarily an initial density.

Accordingly, when the density of the developer is increased, a bulk density of the developer is increased so that the developer cannot be sufficiently collected within the second developer storage room having the same size as the first developer storage room.

SUMMARY OF THE INVENTION

It is therefore an object of the present invention to provide a developing apparatus in which developers are simultaneously exchanged by one developer cartridge so that a user can exchange the developers simply and reliably and it is possible to prevent the developers from being leaked and unnecessarily deteriorated.

Another object of the present invention is to provide a developing apparatus for efficiently and smoothly performing the exchanging operation of the developers without wasting time in the body of an image forming apparatus.

Another object of the present invention is to provide a developing apparatus in which no collected developer overflows from a second developer storage room and a waiting time for collecting the developer is reduced.

The above objects of the present invention can be achieved by a developing apparatus comprising a developer cartridge having a first developer storage room for storing an unused new developer, a second developer storage room for storing a used old developer, and shutter members for opening and closing openings of the first and second developer storage rooms; and means for detachably attaching the developer cartridge to a section for exchanging the old developer for the new developer on a body side of the developing apparatus.

The developing cartridge may be attached and detached form the developer exchanging section after deterioration of the developer in use is displayed, and the used developer is collected within the second developer storage room and the new developer is supplied into the developer cartridge after the collection of the used developer.

The developer cartridge may be attached to the body of the developing apparatus at any time, and the used developer may be collected within the second developer storage room by operating the developer cartridge by a control signal from the body side of the developing apparatus when life of the developer in use is completed.

The developing apparatus may further comprise means for controlling an exchanging operation of the old and new developers to be gradually performed.

An exchanging operation of the old and new developers may be controlled to be performed while a copying operation is stopped.

An exchanging operation of the old and new developers may be controlled to be performed every predetermined number of image forming operations.

A storable volume of the second developer storage room may be larger than that of the first developer storage room.

In accordance with the above-mentioned structure, the old and new developers are simultaneously exchanged by one developer cartridge so that a user can exchange the developers simply and reliably and it is possible to prevent the developers from being leaked and unnecessarily deteriorated.

Further, the exchanging operation of the old and new developers is performed efficiently and smoothly without wasting time in the body of an image forming apparatus.

Further, no collected developer overflows from a second developer storage room and a waiting time for collecting the developer is reduced.

The effects of the present invention can be concretely obtained as follows.

The developer cartridge is attached onto the body side of the developing apparatus and the shutter members are then operated, thereby exchanging the old developer for the new developer.

The old developer is collected and the new developer is supplied by the control means little by little. Accordingly, the old and new developers are not unbalanced in comparison with the case in which the new developer is supplied into the body side of the developing apparatus at one time.

The old and new developers are exchanged during the stoppage of a copying operation in an image forming apparatus, i.e., after the completion of the copying operation. Accordingly, there is no wasting time caused by interruption of the copying operation.

The old and new developers are exchanged every predetermined number of image forming operations so that it is possible to efficiently exchange the old and new developers in accordance with the deterioration of the developer depending on the number of image forming operations.

Since the volume of the second developer storage room is larger than that of the first developer storage room, it is possible to prevent the collected developer from overflowing from the second developer storage room in advance.

Further objects and advantages of the present invention will be apparent from the following description of the preferred embodiments of the present invention as illustrated in the accompanying drawings.

BRIEF DESCRIPTION OF THE DRAWINGS

FIGS. 1 to 13 are views for explaining a developing apparatus in a first embodiment of the present invention in which:

FIG. 1 is a longitudinal sectional view of a main section of the developing apparatus;

FIG. 2 is a perspective view of a member for conveying and rotating a developer;

FIGS. 3 and 4 are views for explaining an electrical connection structure between a developer cartridge and a body of the developing apparatus;

FIG. 5 is a perspective view of the developer cartridge;

FIG. 6 is a longitudinal sectional view of a section for exchanging old and new developers;

FIG. 7 is a longitudinal sectional view of the developer cartridge;

FIG. 8 is a cross-sectional view showing a shutter position when the old developer is collected in the developing apparatus;

FIG. 9 is a cross-sectional view showing a shutter position when the new developer is supplied into the developing apparatus;

FIG. 10 is a cross-sectional view showing a shutter position when the developer cartridge is taken out of the developing apparatus;

FIG. 11 is a flow chart of a developer exchanging operation in the developing apparatus;

FIG. 12 is a flow chart of a modified example of the developer exchanging operation in the developing apparatus; and FIG. 13 is a flow chart for starting the collection of the old developer in the developer exchanging operation in the developing apparatus;

FIGS. 14 to 18 are views for explaining a developing apparatus in a second embodiment of the present invention in which:

FIG. 14 is a longitudinal sectional view of a main section of the developing apparatus;

FIG. 16 is a flow chart of a developer exchanging operation in the developing apparatus;

FIG. 17 is a flow chart of a modified example of the developer exchanging operation in the developing apparatus; and FIG. 18 is a characteristic graph showing deterioration of the developer with the passage of time;

FIGS. 19 to 22 are views for explaining a developing apparatus in a third embodiment of the present invention in which:

FIG. 19 is a longitudinal sectional view of a developer cartridge in the developing apparatus;

FIG. 20 is a control block diagram of the developing apparatus; and

FIGS. 21 and 22 are views for explaining nonexistent and existent states of the developer; and FIGS. 23 to 25 are views for explaining a developing apparatus in a fourth embodiment of the present invention in which:

FIG. 23 is a longitudinal sectional view of a device for exchanging developers;

FIG. 24 is a longitudinal sectional view of a central portion of a cartridge for exchanging the developers; and FIG. 25 is a graph showing the relation between inclination of an inner wall of a room for storing an unused developer and fluidity of the developer.

DESCRIPTION OF THE PREFERRED EMBODIMENTS

The preferred embodiments of a developing apparatus in the present invention will next be described in detail with reference to the accompanying drawings.

Figure 1:
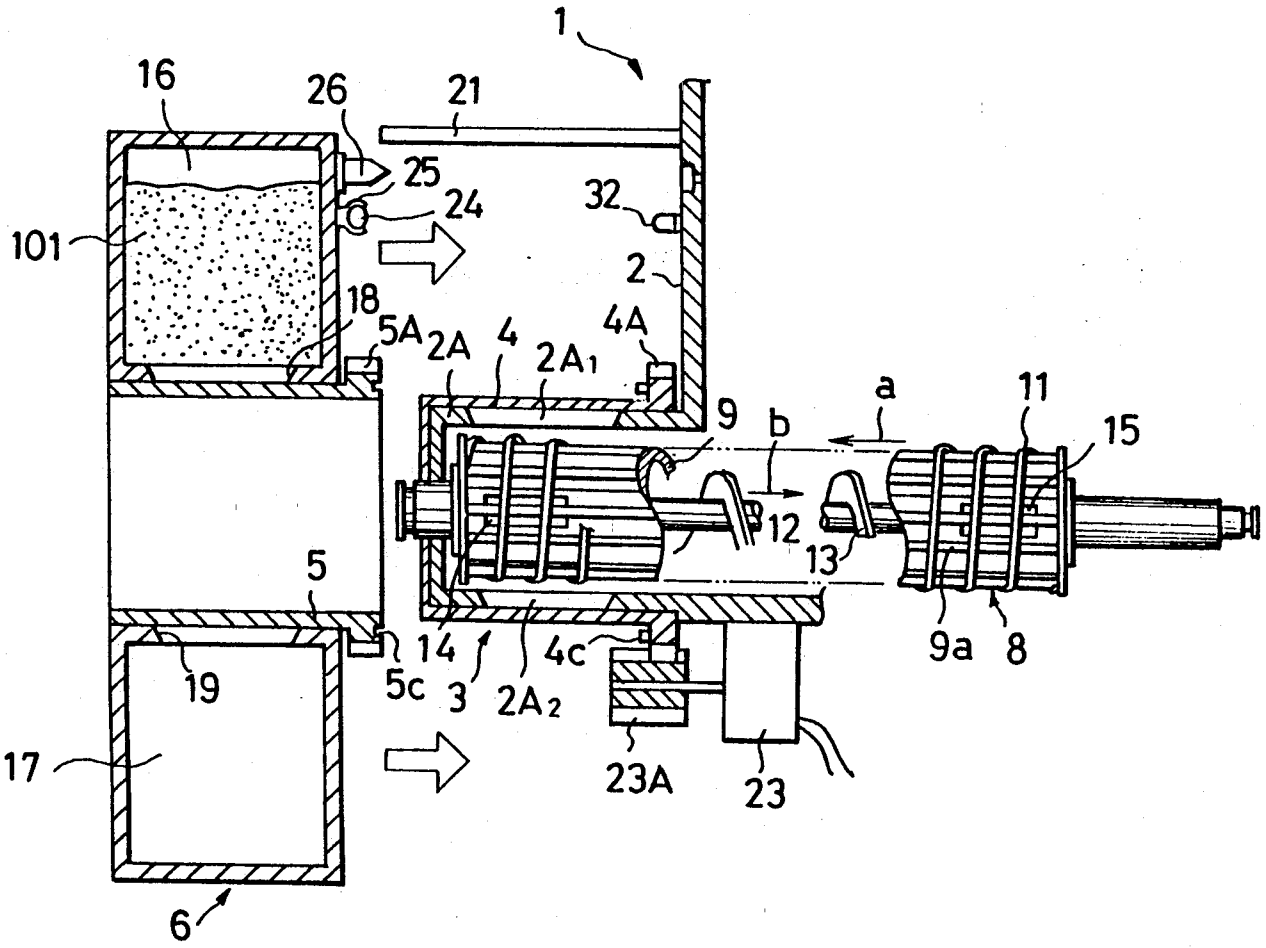

FIG. 1 is a cross-sectional view showing a main section of a developing apparatus in a first embodiment of the present invention. A developing container 2 stores an unillustrated developer in a body 1 of the developing apparatus. A section 3 for exchanging old and new developers is disposed in the developing container 2 and projects outside the developing container 2. This developer exchanging section 3 is constructed by a cylindrical portion 2A projected from the developing container 2 and having an upper opening $2A_1$ and a lower opening $2A_2$. The developer exchanging section 3 is also constructed by a shutter member 4 fitted into the cylindrical portion 2A and integrally formed with a gear 4A.

A member 8 for conveying and rotating the developer is disposed within the developing container 2. One end of this developer conveying-rotating member 8 is extended to an internal portion of the cylindrical portion 2A.

Figure 2:
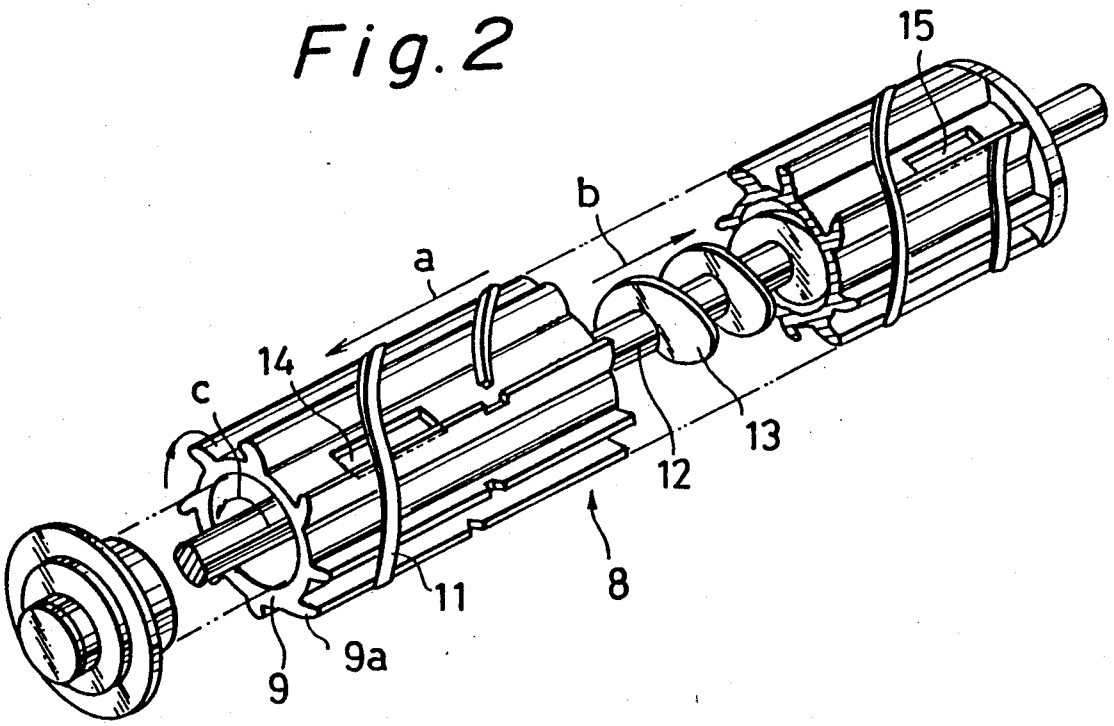

FIG. 2 is a perspective view of the developer conveying-rotating member. As shown in FIG. 2, the developer conveying-rotating member 8 is constructed by a hollow shaft 9 integrally formed with a plurality of blades 9*a* for moving the developer upward. The developer conveying-rotating member 8 is also constructed by an external screw 11 fixed to the hollow shaft 9 therearound, an internal screw 13 integrally formed with a shaft 12 within the hollow shaft 9, etc.

When the hollow shaft 9 and the shaft 12 are respectively rotated in the direction of an arrow c, the developer within the developing container 2 is conveyed by the external screw 11 in the direction of an arrow a. In the meantime; the developer is moved into the hollow shaft 9 through an injection port 14 for the developer. The developer is then conveyed by the internal screw 13 in the direction of an arrow b different from the above direction shown by the arrow a.

The developer is moved outside the hollow shaft 9 through an outflow port 15 for the developer and is again conveyed in the direction of the arrow a. Thus, the developer is circulated inside and outside the hollow shaft 9. When the developer is thus circulated, toner is supplemented into the developer from an unillustrated toner hopper in the developer exchanging section 3 in accordance with necessity. While the developer is conveyed in the direction of the arrow a, the developer is moved upward by the developer raising blades 9*a* and is supplied to an unillustrated developing sleeve. Simultaneously, an electrostatic latent image formed on an unillustrated photosensitive body is visualized.

In FIG. 1, when the developer within the developing container 2 is assumed to be deteriorated and old and new developers are exchanged, a developer cartridge 6 is inserted and attached to an outer circumferential portion of the shutter member 4.

Figure 5:
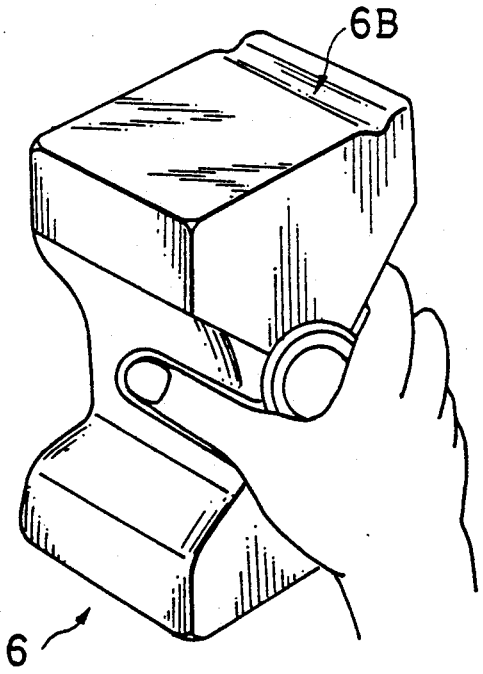
Figure 6:
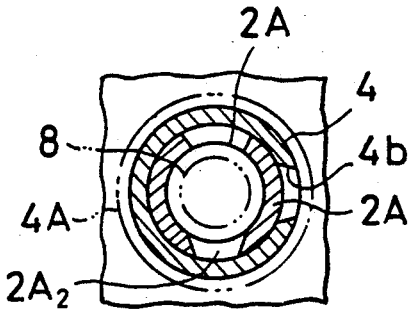
Figure 7:
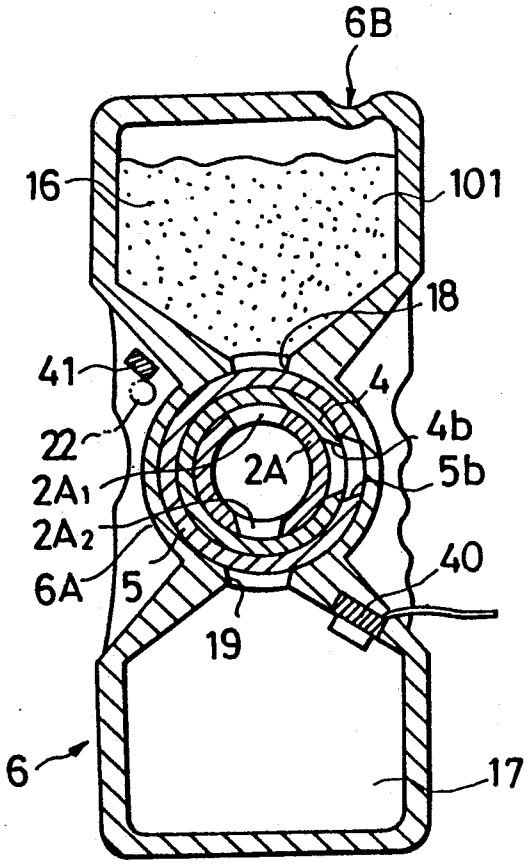

FIG. 5 is a perspective view of the developer cartridge. FIG. 6 is a longitudinal sectional view of the developer exchanging section. FIG. 7 is a longitudinal sectional view of the developer cartridge. The developer cartridge 6 is prepared in advance as a cartridge for exchanging the old developer for a new one. As shown in FIG. 7, the developer cartridge 6 has a first developer storage room 16 for storing a new unused developer 101 in an upper portion thereof. The developer cartridge 6 further has a second developer storage room 17 for storing an old used developer in a lower portion thereof.

A cylindrical portion 6A of the developer cartridge 6 has an opening 18 in a position corresponding to the first developer storage room 16 and an opening 19 in a position corresponding to the second developer storage room 17. A gear 5A is integrally formed at an outer end of an inner circumferential portion of the cylindrical portion 6A. A shutter member 5 having a plurality of openings 5*b* is inserted into the inner circumferential portion of the cylindrical portion 6A. In the following description, such a shutter member is called a cartridge side shutter member and the shutter member 4 is called a developing apparatus side shutter member.

When the old and new developers are exchanged, an unillustrated front cover of the image forming apparatus is opened and an operator grips the developer cartridge 6 in his one hand as shown in FIG. 5. An inner circumferential portion of the cartridge side shutter member 5 is then fitted to the outer circumferential portion of the developing apparatus side shutter member 4 shown in FIGS. 1 and 6 so as to insert and attach the developer cartridge 6 to the developing apparatus. FIG. 7 shows an operating state in which the developer cartridge 6 is completely inserted and attached to the developing apparatus. The new developer is supplied in advance into the first developer storage room 16 of this inserted and attached developer cartridge 6. In contrast to this, the second developer storage room 17 has no developer and is therefore in an empty state.

A groove 6B is disposed in an upper portion of the developer cartridge 6 as shown in FIGS. 5 and 7. When the developer cartridge 6 is inserted as above, A guide bar 21 projected from the developing container 2 is guided by this groove 6B. Thus, the developer cartridge 6 is inserted and attached to the developing apparatus such that the first developer storage room 16 is located on the upper side of the developer cartridge at any time.

As shown in FIG. 7, a projected guide bar 22 is disposed in the developer cartridge 6 and is inserted into an unillustrated hole disposed in the developing container 2. The developer cartridge 6 can be also inserted and attached to the developing apparatus by such a construction.

When such a construction is used, it is possible to prevent an operator from setting the developer cartridge in error.

As shown in FIG. 7, the plurality of openings 5*b* of the cartridge side shutter member 5 are respectively aligned with a plurality of openings 4*b* disposed in the developing apparatus side shutter member 4 in a state in which the developer cartridge 6 is completely inserted and attached to the developing apparatus. The openings 5*b* are respectively aligned reliably with the openings 4*b* by fitting a recessed portion 5*c* disposed on an end face of the cartridge side shutter member 5 to a projected portion 4*c* disposed in the developing apparatus side shutter member 4. Further, the gear 5A is engaged with a motor gear 23A engaged with the gear 4A of the developing apparatus side shutter member 4 in the state in which the developer cartridge 6 is completely inserted and attached to the developing apparatus.

After the developer cartridge 6 is set as above, the front cover is closed, or an unillustrated switch for exchanging the developers is manually pushed after the front cover is closed. Thus, a motor 23 is rotated and both the shutter members 4 and 5 are thereby rotated.

Figure 8:
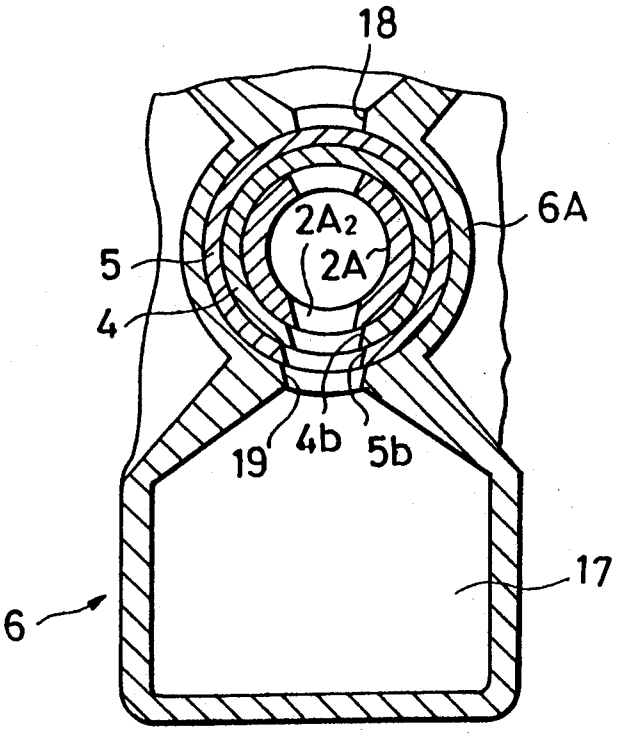
Figure 9:
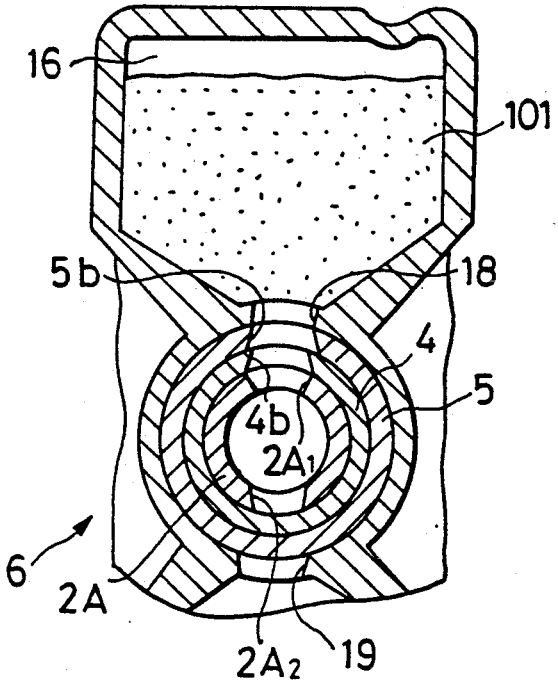
Figure 10:
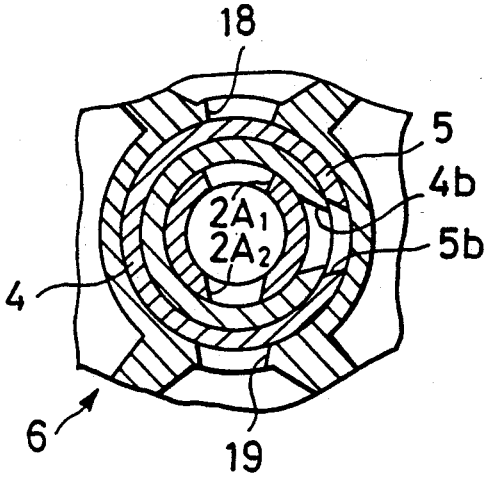

FIG. 8 is a view for explaining a shutter state when the old developer is collected. FIG. 9 is a view for explaining a shutter state when the new developer is supplied. FIG. 10 is a view for explaining a shutter state when the developer is sealed. When both the shutter members 4 and 5 are rotated and located in positions shown in FIG. 8, the rotation of the motor 23 is stopped. The motor 23 may be automatically rotated when the front cover is closed without using the above developer exchanging switch.

Thus, the openings $2A_2$, 4*b*, 5*b* and 19 are aligned with each other as shown in FIG. 8.

In such an operating state, the developing apparatus is operated and the developer conveying-rotating member 8 shown in FIG. 2 is rotated. The developer is thus conveyed in the direction of the arrow a in FIG. 1 and drops through a series of openings aligned with each other as above and is stored into the second developer storage room 17. Namely, the old used developer within the developing container 2 is collected within the second developer storage room 17.

After the old developer has been collected as above, the above motor 23 is rotated again. When both the shutter members 4 and 5 are rotated and located in positions shown in FIG. 9, the rotation of the motor 23 is stopped. To accurately stop the rotation of the motor 23, it is effective to use a servo motor, a step motor, etc. as the motor 23.

Both the openings **4*b* and 5*b* are located on the upper side of the developer cartridge 6 in the operating state shown in FIG. 9 so that all the four openings are aligned with each other. Accordingly, the new developer 101 within the first developer storage room 16 is moved into the cylindrical portion 2A through these openings. When the developing apparatus is operated in this state, the developer moved into the cylindrical portion 2A is conveyed by the developer conveying-rotating member 8 shown in FIG. 8 and is stored within the developing container 2**.

The old developer has been thus exchanged for the new developer. Thereafter, the motor 23 is rotated again and the rotation of the motor 23 is stopped when both the shutter members 4 and 5 are rotated until a rotary position for closing the openings $2A_1$ and $2A_2$, e.g., a rotary position shown in FIG. 10.

In this state, the developer cartridge 6 is pulled out of the outer circumferential portion of the developing apparatus side shutter member 4 together with the cartridge side shutter member 5. In this case, there is no fear that the internal developer is leaked outside the developer cartridge 6 since the openings $2A_1$ and $2A_2$ are already closed in the developing apparatus side shutter member 4.

When the cartridge side shutter member 5 is rotated together with the developing apparatus side shutter member 4, the developer cartridge 6 tries to rotate together with the rotation of the cartridge side shutter member 5. However, such rotation of the developer cartridge 6 is prevented since the guide bar 21 in FIG. 1 is fitted to the groove 6B of the developer cartridge in FIG. 7. In this embodiment, a shutter is opened and closed by rotating the shutter members 4 and 5. However, it is possible to open and close the shutter by setting the developer cartridge 6 to be rotatable and rotating this developer cartridge 6 instead of the rotation of the shutter members 4 and 5.

After the old and new developers have been completely exchanged, the completion of the exchanging operation is displayed in an operation panel portion, etc. of the image forming apparatus. The operator sees this display and takes the developer cartridge 6 out of the developing apparatus and throws this cartridge away.

The taken-out developer cartridge after the exchanging operation thereof is called an old developer cartridge in the following description. When the old developer cartridge is not thrown away, but is mixed with the new developer cartridge, there is a possibility that the old developer cartridge is inserted and attached to the developing apparatus in error at the next exchanging time of the developers. If such a thing occurs, the collected developer overflows and no old developer can be collected in a certain case since the collected developer is already stored within the second developer storage room 17. Further, no new developer can be supplied to the developing apparatus since the first developer storage room 16 is empty.

When the guide bar 21, the groove 6B, etc. are not disposed, there is a case in which the developer cartridge is attached to the developing apparatus upside down and the collected developer within the second developer storage room 17 is supplied into the developing apparatus. In such a case, the deteriorated developer is used to perform the developing operation so that the quality of an image is reduced.

As shown in FIG. 1, an electric conductive member 24 is disposed on the side of the developer cartridge 6 such that an electrical turning-on state of this conductive member 24 is interrupted in accordance with the insertion and attachment of the developer cartridge. In this embodiment, a fuse is used as this conductive member 24 and is fixedly held by a holder 26 on the side of the developer cartridge 6.

Figure 3:
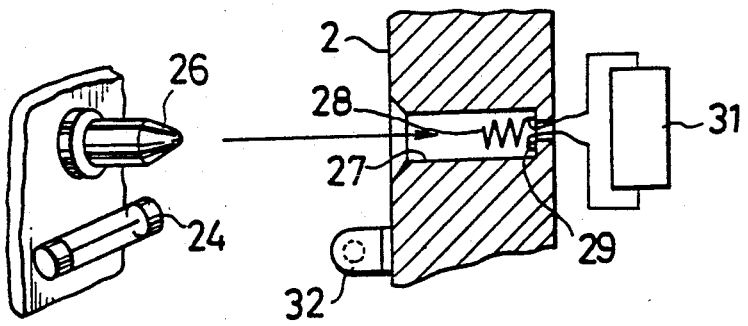
Figure 4:
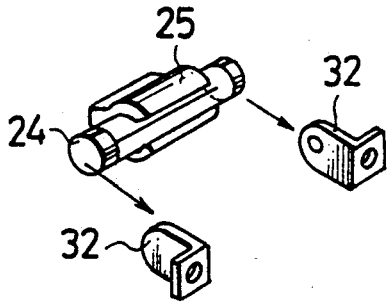

A projecting member 26 is disposed in the developer cartridge 6. When the developer cartridge 6 is inserted and attached to the developing apparatus, the projecting member 26 is inserted into a hole 27 disposed in the developing container 2 as shown in FIG. 3. Thus, the projecting member 26 pushes a conductive spring 28 so that a contact 29 is closed. As shown in FIG. 4, both ends of the fuse 24 are connected to both electric terminals 32, 32 on the side of the developing container 2.

An unillustrated operation panel section in the image forming apparatus displays that the developer cartridge 6 is set through an electric control section 31 in a state in which the contact 29 is closed. Further, after the contact 29 is closed, an electric current flows through the fuse 24 for a constant time required to collect the old developer and supply the new developer, thereby automatically blowing this fuse. Namely, the fuse 24 is blown at any time with respect to the developer cartridge taken out of the developing apparatus after the completion of the exchanging operation of the developers. When the fuse 24 is blown, no electric current is supplied to the motor 23 and no motor 23 is thereby operated even when this developer cartridge 6 is attached to the body of the developing apparatus as mentioned above.

Since the electric conductive member such as the fuse blown in accordance with the insertion and attachment of the developer cartridge 6 is disposed in the developer cartridge 6, it is possible to prevent the above-mentioned problems from being caused when the old developer cartridge is reattached to the developing apparatus in error.

For example, when the new developer cartridge is inserted and attached to the developing apparatus, an electric current flows through the fuse 24. In contrast to this, when the old developer cartridge is inserted and attached to the developing apparatus, no electric current flows through the fuse 24. Therefore, a message such as "old developer cartridge has been set" can be displayed on the operation panel by such a difference in electric current between the new and old developer cartridges. Simultaneously, the developing apparatus can be constructed to be unoperated.

Thus, it is possible to prevent the exchanging operation with respect to the old developer cartridge in advance. Accordingly, it is possible to prevent the collection of the old developer from being disabled and no new developer from being supplied into the developer apparatus for any length of time. Further, it is possible to prevent the old developer from being supplied into the developing apparatus. Thus, an ordinary user can simply exchange the old developer for the new developer.

The electric conductive member is composed of the fuse blown by heat caused by an electric current flowing therethrough, but can be constructed by a member blown when a voltage applied between the electric terminals 32, 32 in FIG. 4 has reached a predetermined value.

In FIG. 7, a collection detecting means 40 for detecting the collection of the developer is disposed in the second developer storage room 17. This collection detecting means 40 is constructed by e.g., a piezoelectric element. A magnetic sensor 41 detects whether or not the developer cartridge 6 is set and there is the new developer 101 within the first developer storage room 16.

Figure 11:
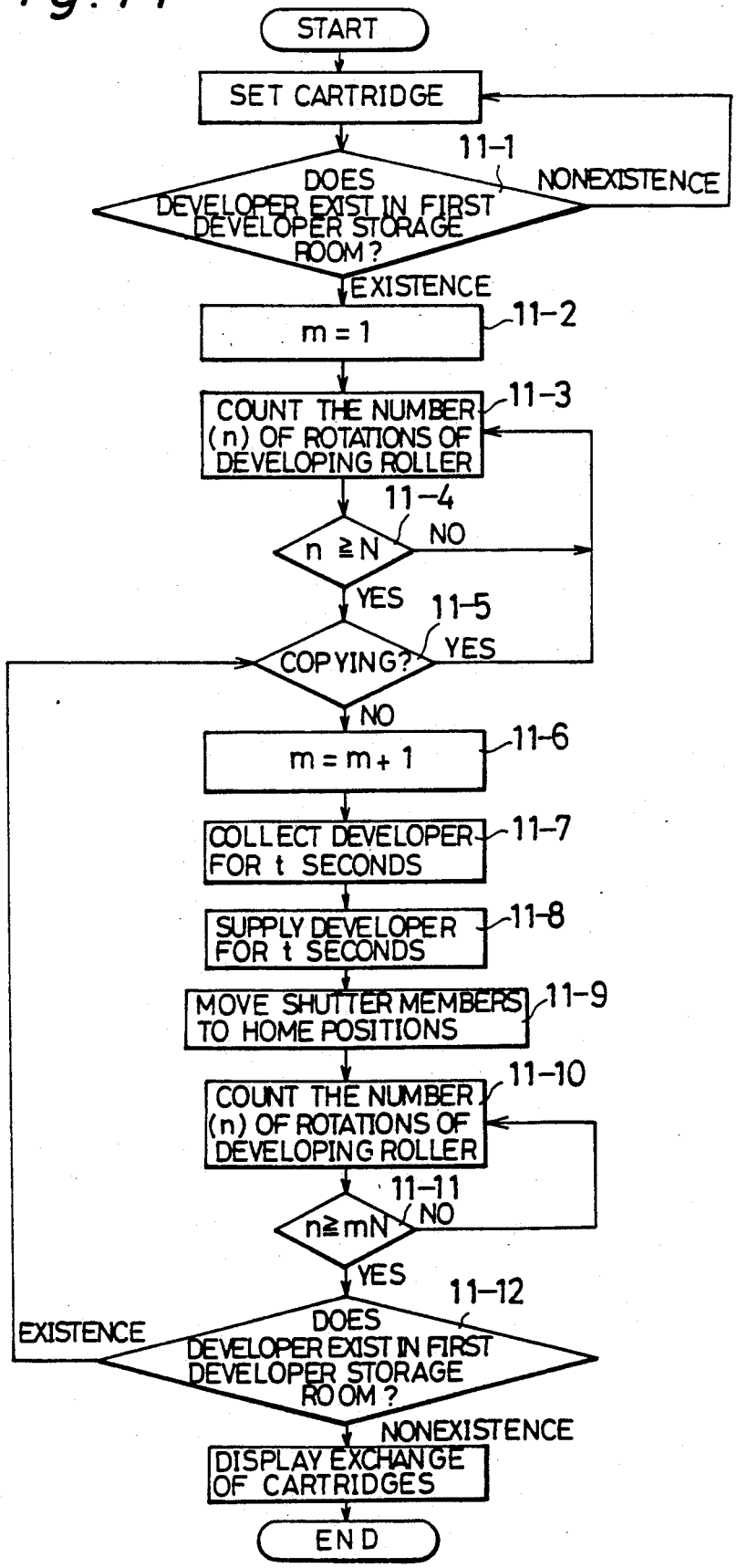

FIG. 11 is a flow chart of the developer exchanging operation in the developing apparatus in the present invention. When the magnetic sensor 41 detects that the new developer is stored within the first developer storage room 16, the shutter members 4 and 5 attain a standby state. Then, the number (n) of rotations of a developing roller is counted and is compared with a preset number N. When the number of rotations of the developing roller is equal to the present number N, it is judged whether a copying operation is performed or not. When the copying operation is completed, the motor 23 is operated and the shutter members 4 and 5 are rotated. The old developer is then collected for a time t and the new developer is next supplied to the developing apparatus for the time t. The old and new developers are exchanged little by little by such collecting and supplying operations (see steps 11-1 to 11-12 in FIG. 11).

Figure 12:
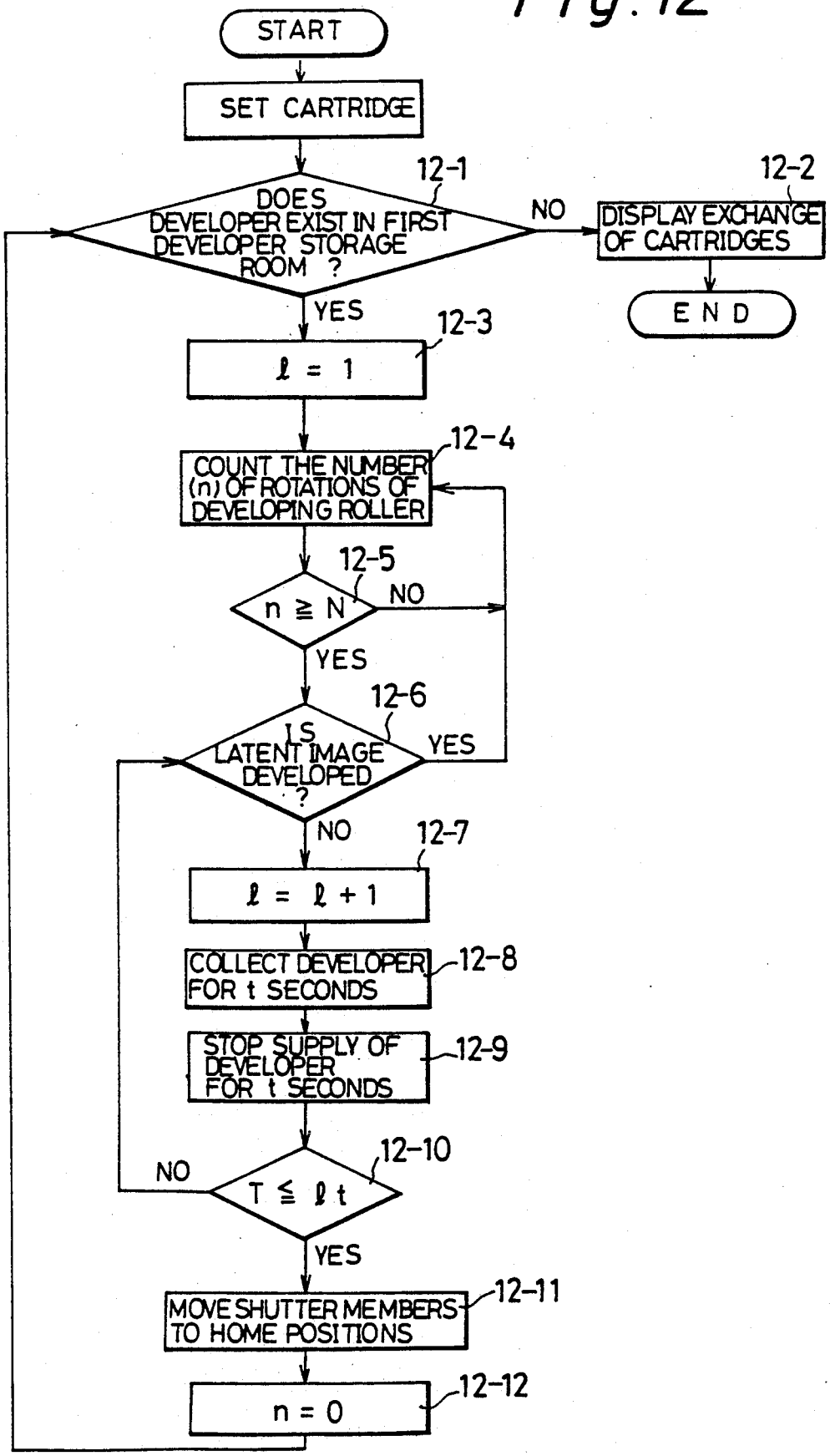

FIG. 12 is a flow chart of a modified example of the developer exchanging operation in the developing apparatus in the present invention. After a user sets the developer cartridge 6, the magnetic sensor 41 detects in a step 12-1 whether or not the new developer 101 is stored within the first developer storage room 16. When the new developer 101 is stored within the first developer storage room 16, the shutter members 4 and 5 attain the standby state. Next, the number (n) of rotations of the developing roller is counted and is compared with the preset number N. When the number of rotations of the developing roller is equal to the preset number in steps 12-3 to 12-5, it is judged in a step 12-6 whether the developing apparatus is developing a latent image or not. When no developing apparatus is developing the latent image, the motor 23 is operated and the old developer is collected for the time t and the new developer is next supplied into the developing apparatus for the time t in steps 12-7 to 12-9. When the next latent image is developed, the shutter members 4 and 5 are closed and are opened after the completion of the developing operation. This operation is performed in a step 12-10 until a time T required to exchange a constant amount of developers has passed. The above-mentioned operations are not performed when the copying operation is completed, but are continuously performed at the next copying time. Thus, the old developer is collected and the new developer is supplied repeatedly so that the old and new developers are exchanged little by little. Thereafter, the positions of the shutter members 4 and 5 are returned to their home positions and the number (n) of rotations of the developing roller is returned to zero in steps 12-11 and 12-12.

When no developer is stored within the first developer storage room 16 and the judgment in the step 12-1 is therefore NO, the exchange of the developer cartridge 6 is displayed in the step 12-2. The old and new developers are not exchanged during the developing operation since no newly supplied developer is sufficiently mixed and stirred so that there is a fear that an obtained image has an irregular density.

Figure 13:
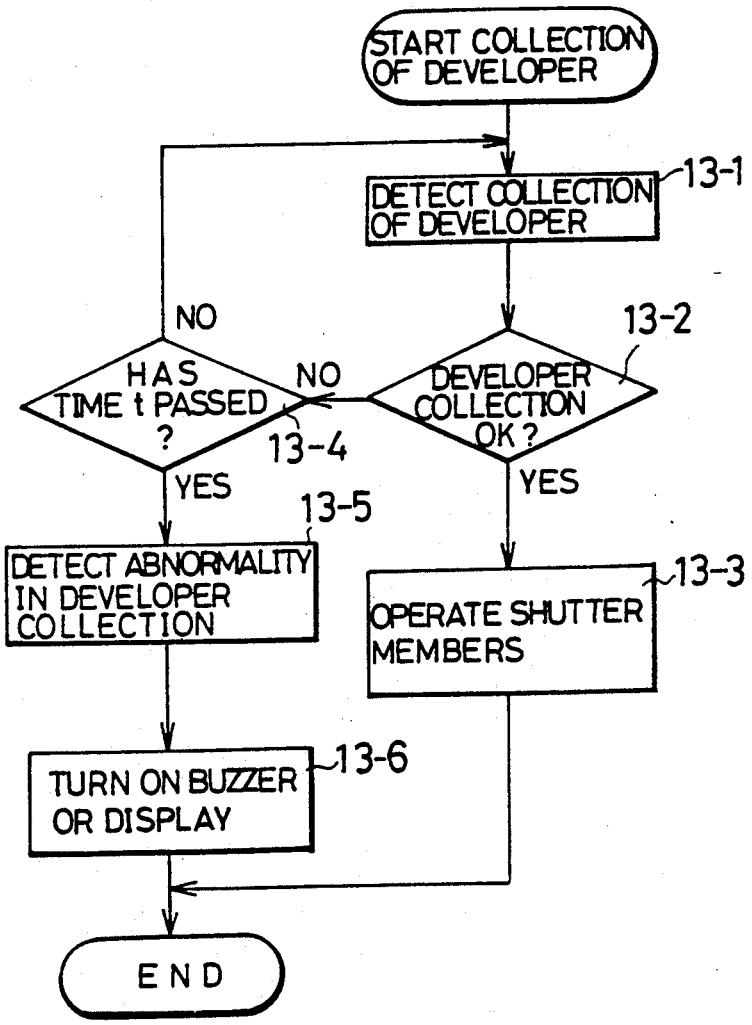

FIG. 13 is a flow chart for starting the collection of the old developer in the developer exchanging operation in the developing apparatus in the present invention. The collection detecting means 40 disposed in the second developer storage room 17 detects the collection of the old developer in a step 13-1. When the old developer is completely collected and the judgment in a step 13-2 is therefore YES, the shutter members 4 and 5 are operated and the new and old developers are exchanged as mentioned above in a step 13-3.

When no collection of the old developer is completed after a predetermined time and the judgments in steps 13-2 and 13-4 are respectively NO and YES, abnormality is caused and detected in a step 13-5. Thus, this abnormality is informed by a buzzer or displayed by a display device in a step 13-6.

Figure 14:
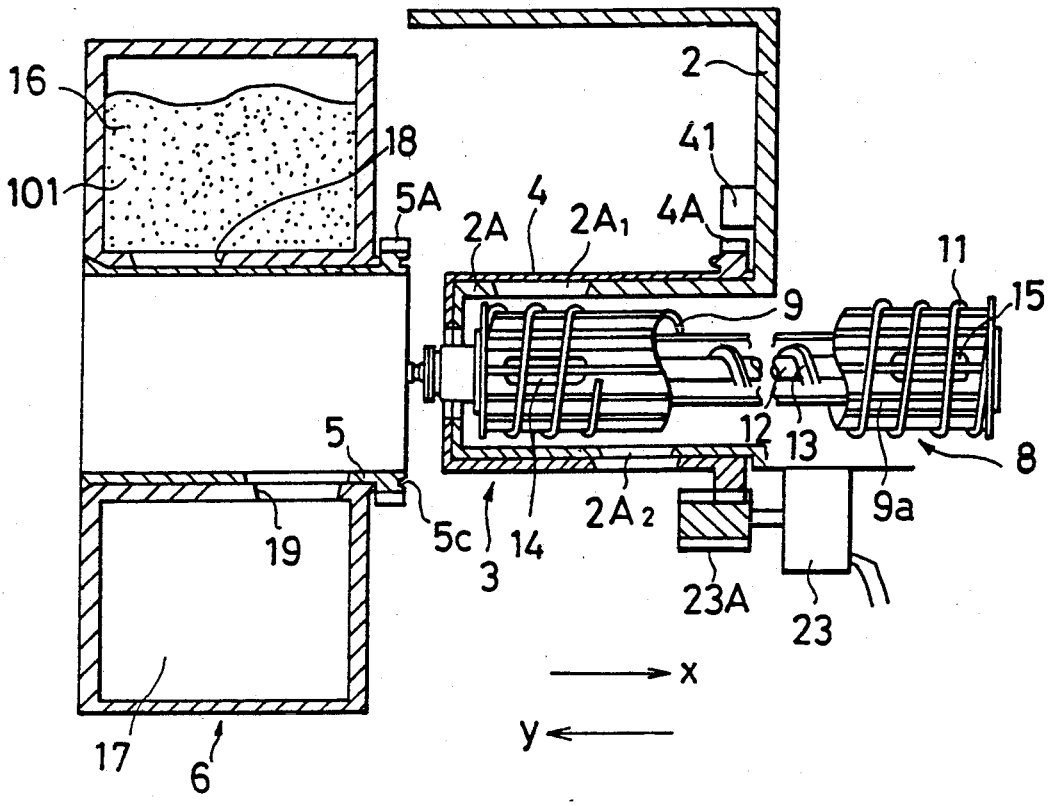

FIG. 14 is a longitudinal sectional view of a developing apparatus in a second embodiment of the present invention. In this second embodiment, an old user developer is replaced by a new unused developer 101 little by little. Therefore, the position of a supplying passage of the new developer 101 and the position of a collecting passage of the old developer are shifted from each other.

Figure 15A:
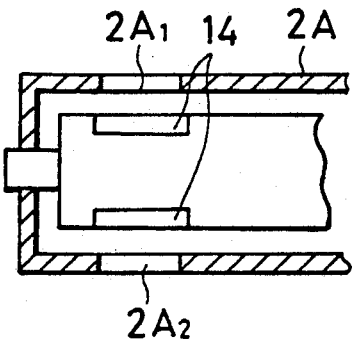
FIGS. 15*a* and *b* is a longitudinal sectional view of a main section for exchanging old and new developers.
Figure 15B:
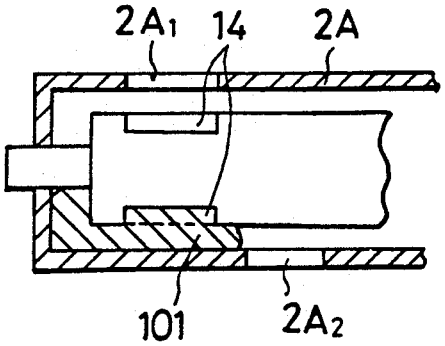

FIGS. 15*a* and 15*b* are longitudinal sectional views of a main section for exchanging the old and new developers. As shown in FIG. 15*a*, when a developer injection port 14 and openings $2A_1$ and $2A_2$ are located on a vertical line, the new developer 101 is considered to be collected as it is at the supplying time thereof unless the shutter members 4 and 5 are disposed. However, as shown in FIG. 15*b*, if the positions of the openings $2A_1$ and $2A_2$ are shifted from each other, the injected new developer 101 stays on an inner wall of the cylindrical portion 2A even when the new developer 101 drops through the developer injection port 14. The injected new developer 101 is again conveyed into the body 1 of the developing apparatus through the developer injection port 14.

The openings $2A_1$ and $2A_2$ are respectively formed on the front and rear sides of the developing apparatus. This is because, when the openings $2A_1$ and $2A_2$ are respectively formed on the rear and front sides of the developing apparatus, the new developer 101 located within the cylindrical portion 2A is immediately collected by an external screw 11.

In this embodiment, a magnetic sensor 41 is disposed in the developing container 2. When this magnetic sensor 41 is turned on, it is judged that an unused developer cartridge 6 having the new developer therein is set, thereby exchanging the old and new developers.

Figure 16:
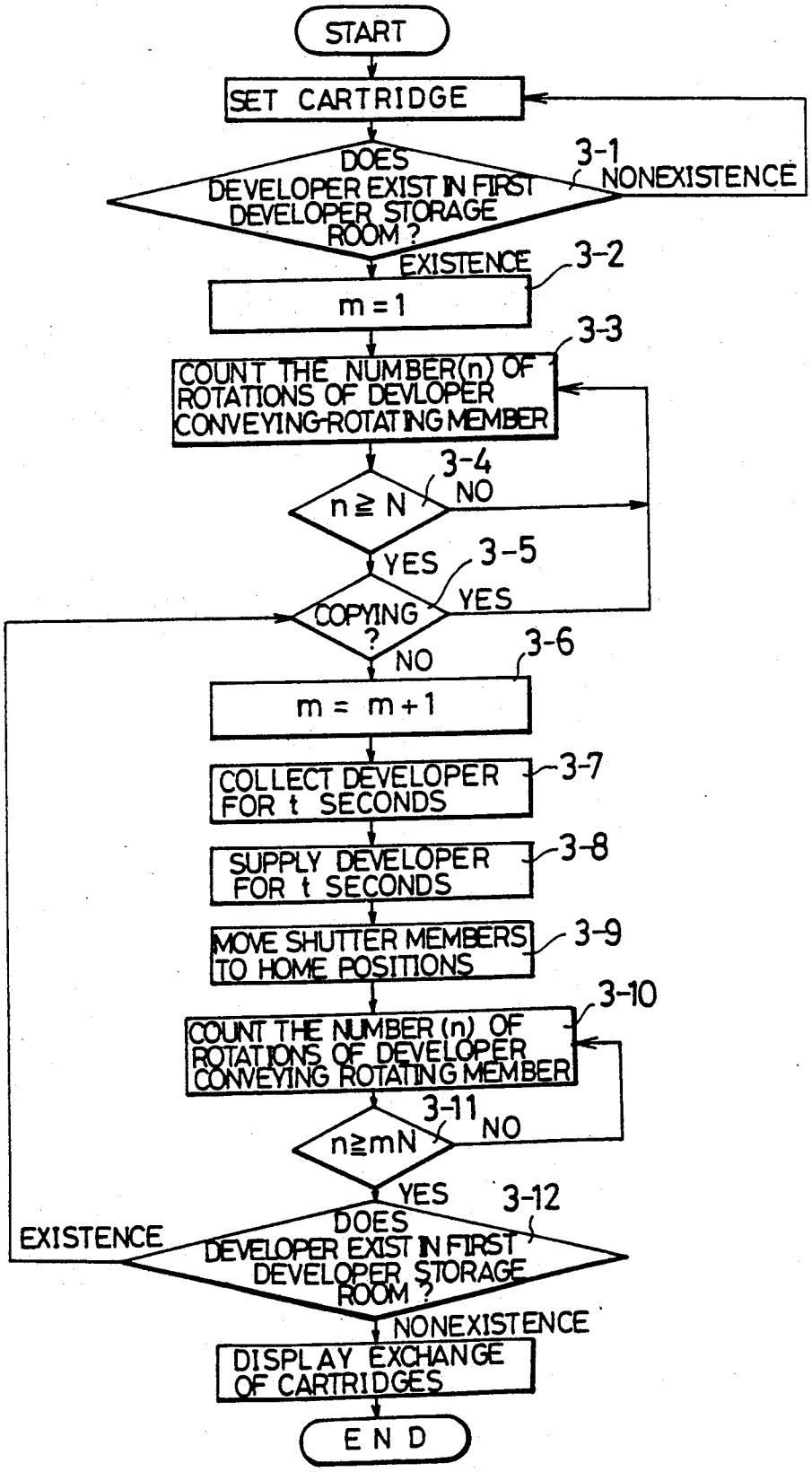

FIG. 16 is a flow chart for judging the life of the developer and finally exchanging the developer cartridges while the included developers are gradually exchanged in the developing apparatus in the second embodiment of the present invention.

In the exchanging operation, the developer cartridge 6 is first inserted and attached to the developing container 2 in a step 3-1 in FIG. 16. Thereafter, the magnetic sensor 41 detects in a step 3-2 whether or not the new developer is stored within the first developer storage room 16. When it is judged in this step that the new developer 101 is stored within the first developer storage room 16, a variable m for prescribing the exchange of the developers is set to 1 in the step 3-2 in consideration of the replacement of the developer from the number of rotations of the developer conveying-rotating member 8. Further, the number (n) of rotations of the developer conveying-rotating member 8 is counted in a step 3-3. Subsequently, in a step 3-4, the number of rotations of the developer conveying-rotating member 8 is compared with the preset number N of rotations thereof decided in accordance with an exchanging interval of the developer. When the number of rotations of the developer conveying-rotating member 8 is equal to the preset value N or exceeds this value N, it is judged in a step 3-5 whether a copying operation is performed nor not. When the copying operation is completed, value 1 is added to the above variable m in a step 3-6. Further, the motor 23 is operated to collect the developer and the shutter members 4 and 5 are rotated and attain the above-mentioned state shown in FIG. 8. This state is maintained for only a preset time t and the developer completed with respect to life within the developing container 2 is collected within the second developer storage room 17 in a step 3-7.

When this collecting operation has been completed, the motor 23 is further operated to supply the new developer and the shutter members 4 and 5 are rotated and attain the operating state shown in FIG. 9. This state is maintained for the preset time t and the developer from the first developer storage room 16 is supplied into the developing container 2 in a step 3-8. Thereafter, in a step 3-9, the motor 23 is rotated to return the positions of the shutter members 4 and 5 to their home positions as shown in FIG. 10, thereby closing all the openings. Thus, a first replacing operation of a predetermined small amount of developer is completely performed.

When the new developer 101 is thus supplied to the developing apparatus, the number n of rotations of the developer conveying-rotating member 8 is counted in a step 3-10. When this number n exceeds the above preset number N in a step 3-11, it is judged in a step 3-12 whether or not the new developer 101 is stored within the first developer storage room 16. When the new developer 101 is stored within the first developer storage room 16, the life of the developer in use is completed. Therefore, it again returns to the above step 3-5 and the processings and operations after this step are repeatedly performed. When there is no new developer 101 left within the first developer storage room 16, the exchange of the developer cartridge 6 is displayed in a step 3-13.

When the number n is less than the preset number N in the step 3-4, it returns to the step 3-3 until the number n is greater than the preset number N. When the copying operation is performed in the step 3-5, this copying operation cannot be interrupted. Accordingly, it similarly returns to the step 3-3 and the processings after this step are repeatedly performed.

Thus, the developer is used until the life thereof and is gradually replaced by the new developer. When there is finally no developer left within the developer cartridge 6, the developer cartridge 6 can be exchanged for a new one.

Figure 17:
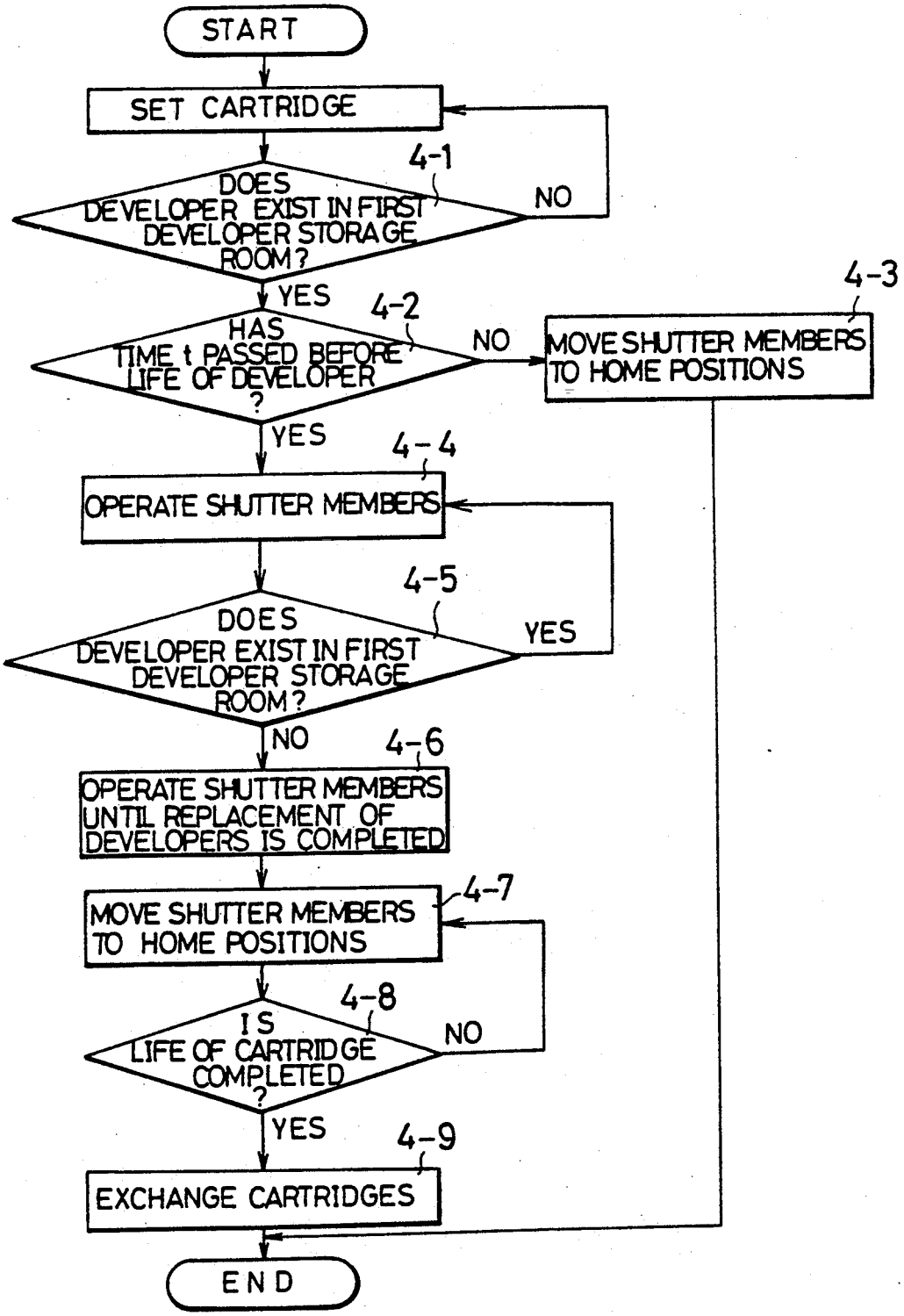

FIG. 17 is a flow chart of another example of the developer exchanging operation in the developing apparatus in the present invention. When a user sets the developer cartridge 6 into the developing container 2 within the body 1 of the developing apparatus, the magnetic sensor 41 detects this setting state. Next, it is judged in a step 4-1 whether the developer is stored on the side of the first developer storage room 16. After a constant time has passed before the life of the developer and the judgment in a step 4-2 is YES, the shutter members 4 and 5 begin to be rotated by the rotation of the motor 23 in a step 4-4. When the constant time does not have passed and the judgment in the step 4-2 is NO, the shutter members 4 and 5 are stopped in their home positions in FIG. 10 which are not located in the upper and lower openings 18 and 19 in a step 4-3. When the openings **4*b* and 5*b* of the shutter members 4 and 5 are aligned with the upper opening 18 as shown in FIG. 9, the new developer 101 is supplied since the judgment in a step 4-5 is YES and it then proceeds to the step 4-4. When the openings 4*b* and 5*b* of the shutter members 4 and 5 are aligned with the lower opening 19 as shown in FIG. 8, the used developer is collected since the judgment in the step 4-5 is NO and it then proceeds to the step 4-6**.

The above-mentioned operations are performed during the copying operation. If abnormality such as jam occurs during the copying operation so that the operation of the developing apparatus is stopped, the shutter members 4 and 5 are rotated toward their home positions which are not aligned with the upper and lower openings 18 and 19. Thus, in a step 4-7, the new unused developer 101 can be prevented from being additionally supplied into the developing apparatus.

The shutter members 4 and 5 are rotated until there is no new developer 101 left within the first developer storage room 16. For example, after the magnetic sensor 41 detects that there is no new developer 101 left within the first developer storage room 16, the shutter members 4 and 5 are rotated to a certain extent until the used developer is replaced by the unused developer. Thereafter, the shutter members 4 and 5 are stopped in their home positions. Thereafter, the life of the developer cartridge approximately similar to that of the developer is completed and the judgment in a step 4-8 is YES. Thus, the old developer cartridge collecting the used developer is thrown away and a new developer cartridge is set.

Figure 18:
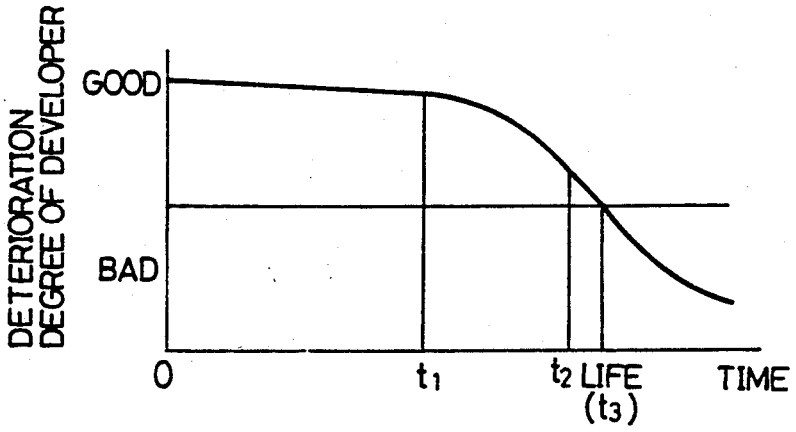

FIG. 18 is a characteristic graph showing the deterioration of the developer with the passage of time. As can be seen from this characteristic graph, the shutter members 4 and 5 are rotated after a constant time has passed since the developer is not deteriorated so much for a first period (0 to $t_1$). It is preferable to replace the old developer by a new developer by rotating the shutter members 4 and 5 at a time interval ($t_1$ to $t_2$) from the beginning of the deterioration of the developer to the life thereof.

Figure 19:
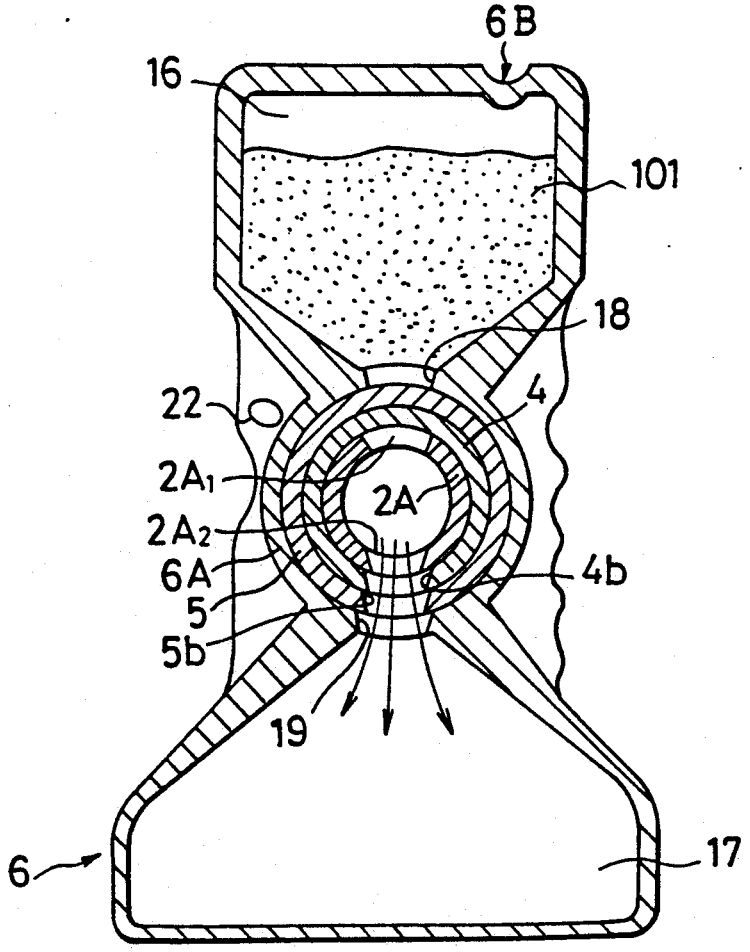

FIG. 19 is a longitudinal sectional view of a developer cartridge in a developing apparatus in a third embodiment of the present invention. A volume of a second developer storage room 17 is larger than that of a first developer storage room 16.

In this embodiment, a new developer 101 shown in FIG. 19 within the first developer storage room 16 has a weight 1 kg and a volume about 500 $cm^3$. When this new developer 101 is manufactured in a factory, the density of the developer 101 is constantly controlled.

With respect to the new developer 101 stored within the developing container 2, toner is consumed and toner density is reduced every development. The development having the reduced toner density is detected by various kinds of sensors and the toner is supplemented from a toner cartridge so as to constantly control the toner density.

However, as mentioned above, there is a case in which the toner density within the developing container 2 is increased by dispersion of supplement, etc. even when the toner density is constantly controlled. In this case, the volume of the developer within the developing container 2 is increased. Therefore, when the life of the old developer is completed and the old developer is exchanged for the new developer 101, the volume of the old developer is not necessarily equal to that of the new developer 101. Accordingly, in this embodiment, the volume of the second developer storage room 17 is set to be larger than that of the first developer storage room.

The second developer storage room 17 may be expanded and contracted by forming this room 17 in the shape of bellows or forming this room 17 by a flexible material, etc. In this case, the second developer storage room 17 is contracted before the collection of the old developer and is expanded by the storage of the old developer when the old developer is collected.

Figure 20:
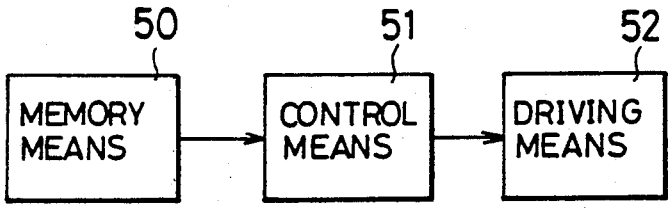

FIG. 20 is a control block diagram of the developing apparatus in the third embodiment of the present invention. A memory means 50 stores the life of the new developer 101 supplied into the developing container 2 and shown by the number of copies. A control means 51 outputs a command signal when the life of the developer in use is completed. A driving means 52 is disposed in the body 1 of the developing apparatus to collect the used developer by the command signal from the control means 51.

Figure 21:
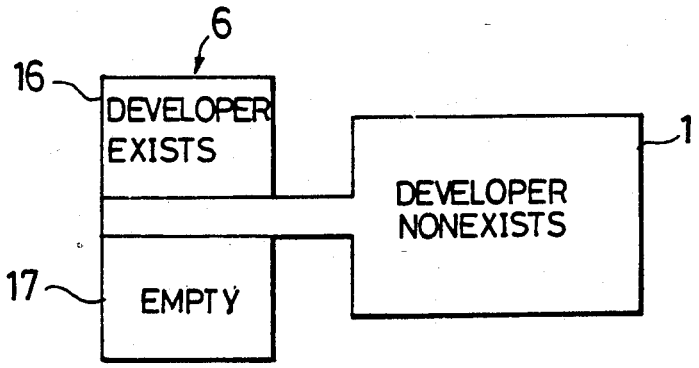
Figure 22:
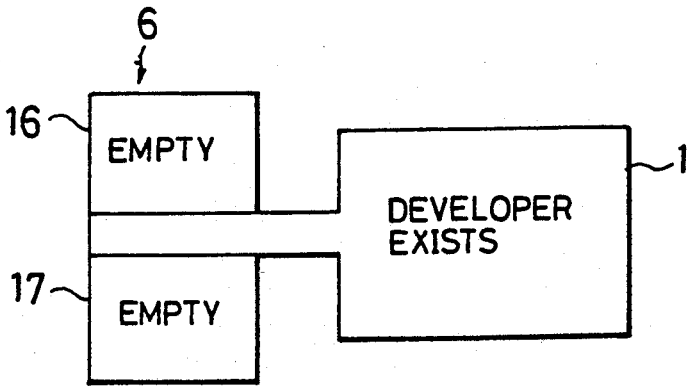

FIGS. 21 and 22 are views for explaining nonexistent and existent states of the developer in the developing apparatus in the second embodiment of the present invention. In each of FIGS. 21 and 22, "developer exists" shows that the developer is stored within the developing apparatus, and "empty" shows that no developer is stored within the developing apparatus.

As shown in FIG. 21, no developer is stored within the body 1 of the developing apparatus immediately forwarded from a factory. An unused developer cartridge 6 is set in the body 1 of the developing apparatus as shown in FIG. 21.

A new developer is supplied by the above-mentioned operations into the developing container 2 in the body 1 of the developing apparatus. The developer cartridge 6 is attached to the developing apparatus as it is even when the supply of the new developer is completed and the first developer storage room 16 becomes empty as shown in FIG. 22. A normal copying operation is performed in the operating state shown in FIG. 22. When the life of the developer is completed, the used developer is automatically collected as mentioned above so that the used developer is collected within the second developer storage room 17.

Figure 23:
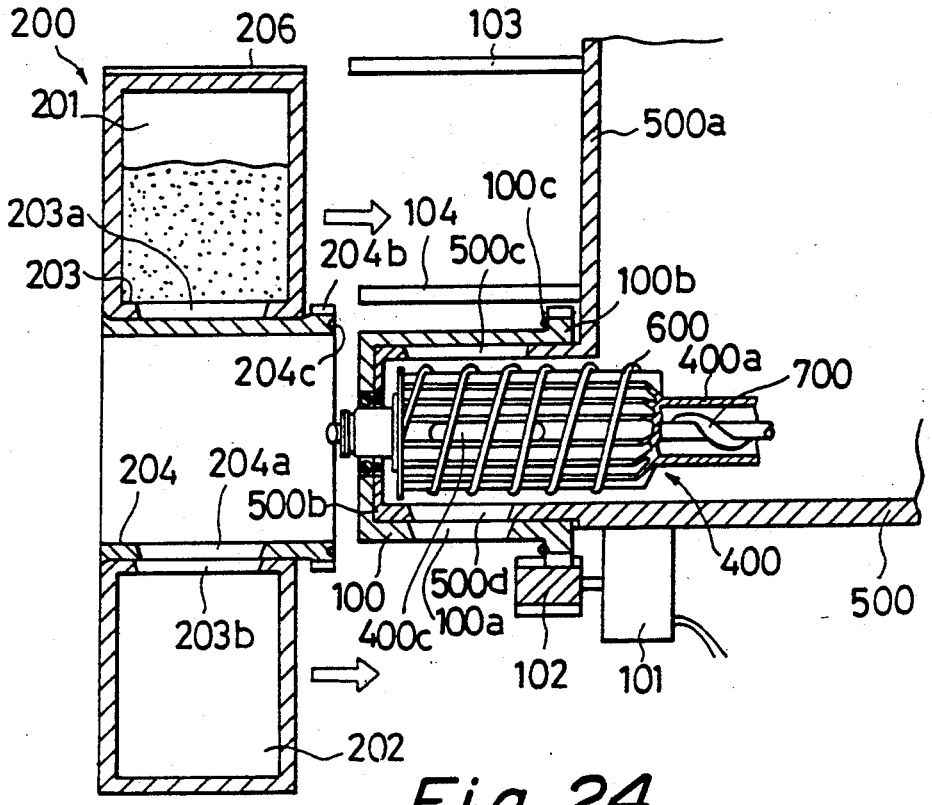
Figure 24:
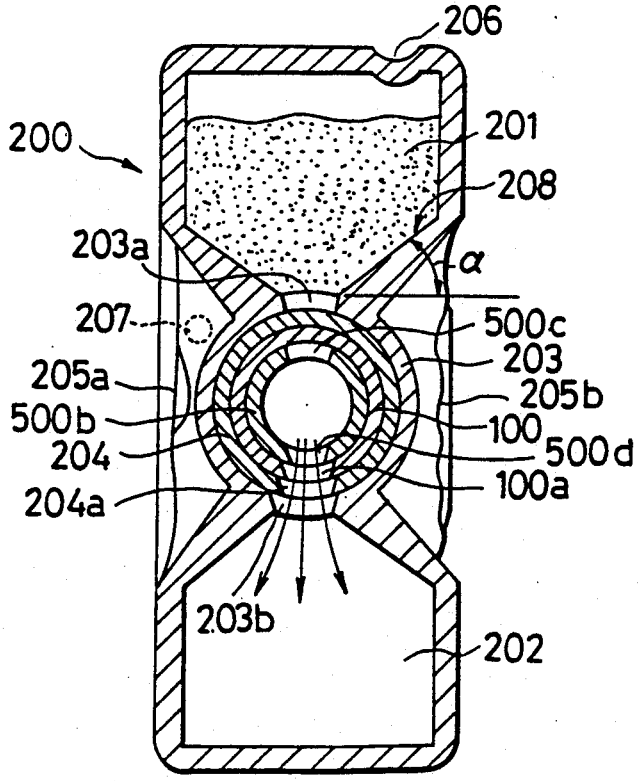
Figure 25:
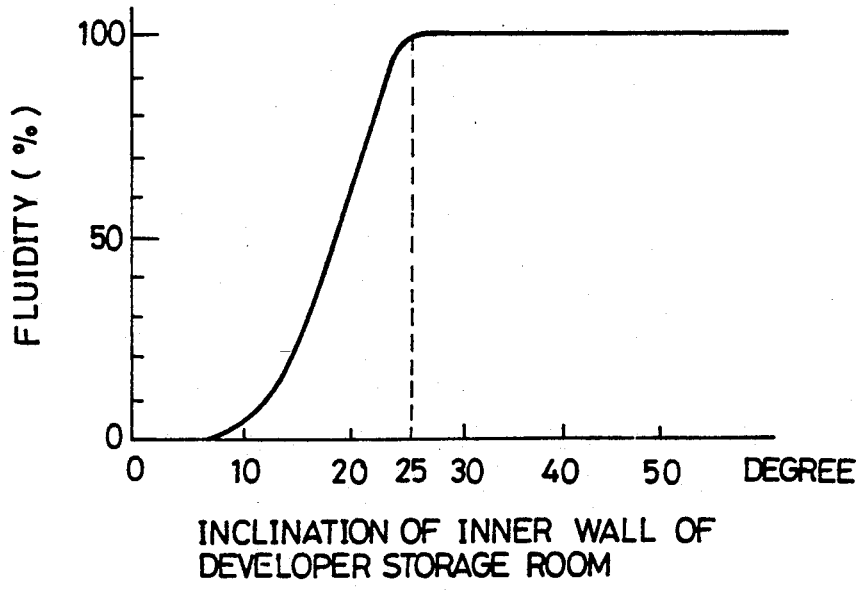

FIGS. 23 to 25 show a developing apparatus in a fourth embodiment of the present invention. A cylindrically projected portion **500*b* is formed in a side wall 500*a* of a developing container 500 and is projected therefrom. A developer supplying port 500*c* and a developer discharging port 500*d* are respectively formed in upper and lower portions of this cylindrically projected portion 500*b*. A blade wheel 400 is disposed within the cylindrically projected portion 500*b* and has a plurality of radial blades. A spiral wire 600 is wounded around this blade wheel 400 over an entire length thereof and surrounds this blade wheel. The wire 600 is rotated in a conveying direction of the developer integrally with the blade wheel 400. A conveying screw 00 is disposed within a hollow shaft 400*a* of the blade wheel 400 and is rotated in a direction reverse to a rotary direction of the blade wheel 400. An end portion of the hollow shaft 400*a* is closed and an inflow port 400*c*** for the developer is disposed on a circumferential face of the blade wheel in the vicinity of this end portion.

A cylindrical shutter member 100 on the side of the developing container is rotatably disposed in an outer circumference of the cylindrically projected portion **500*b*. First and second openings 500*c* and 500*d* are disposed in the cylindrically projected portion 500*b*. A third opening 100*a* is disposed in a portion of the shutter member 100 and selectively corresponds to the first and second openings 500*c* and 500*d*. Further, a gear 100*b* is integrally disposed in an outer circumferential portion of the shutter member 100** on a deeper side thereof.

A pin **100*c* is disposed at an inner end of this gear 100*b* and functions as a reference for aligning the shutter member 100** with a shutter member on the cartridge side described later.

A motor 101 is attached to a bottom plate of the developing container 500. A gear 102 is disposed on a driving shaft of this motor 101 and is engaged with the gear **100*b*. The motor 101 is driven by turning on an unillustrated switch for exchanging old and new developers. A guard rail 103 and a guide pin 104 are parallel to each other and are attached to a side plate 500*a* of the developing container 500. The guard rail 103 and the guide pin 104 are projected in the same direction as the cylindrically projected portion 500*b***.

As shown in FIG. 24, an unused developer storage room 201 is disposed in an upper portion of a cartridge 200 for exchanging the old and new developers and stores an unused developer. A developer collecting room 202 is disposed in a lower portion of this cartridge 200 and collects an unused developer. A cylindrical inner wall 203 is disposed between the unused developer storage room 201 and the developer collecting room 202. This cylindrical inner wall 203 has a fifth opening **203*a* connected to the unused developer storage room 201 and a sixth opening 203*b* connected to the developer collecting room 202**.

A cylindrical shutter member 204 on the cartridge side is rotatably fitted onto an inner side of the cylindrical inner wall 203. A fourth opening **204*a* is disposed in a portion of this shutter member 204 and selectively corresponds to the fifth and sixth openings 203*a* and 203*b***.

An inner end of the shutter member 204 on the side of the developing container 500 is projected from the cartridge 200 and a gear **204*b* is disposed in this projected portion. A small hole 204*c* is disposed on an outer end face of the gear 204*b*. This small hole 204*c* functions as a reference for aligning the shutter member 204 on the cartridge side with the shutter member 100 on the side of the developing container when the shutter member 204 is fitted to the shutter member 100 in relation to the pin 100*c*** of the shutter member on the side of the developing container.

In this developer exchanging device, the sizes of the first opening **500*c*, the second opening 500*d*, the third opening 100*a*, the fourth opening 204*a***, the fifth opening 203*a* and the sixth opening 203*b* are respectively set as follows. Namely, the size of the third opening 100*a* is larger than the sizes of the first and second openings 500*c* and 500*d*. The size of the fourth opening 204*a* is larger than that of the third opening 100*a*. Further, the sizes of the fifth and sixth openings 203*a* and 203*b* are larger than the size of the fourth opening 204*a*. Thus, when the used developer drops toward the developer collecting room 202, it is possible t prevent the developer from being leaked from a clearance between the shutter member 100 on the side of the developing container and the shutter member 204 on the cartridge side.

As shown in FIG. 24, a recessed portion 205*a* for receiving a thumb and a recessed portion 205*b* for receiving the remaining fingers are disposed on an outer side of the cylindrical inner wall 203 of the cartridge 200 for exchanging the old and new developers. The recessed portion 205*a* is disposed on the left-hand side of the cartridge 200 seen from the front side thereof (leftward in FIG. 23) and the recessed portion 205*b* is disposed on the right-hand side of the cartridge 200. These recessed portions 205*a* and 205*b* constitute a hand grip. This hand grip is used to easily grasp the cartridge in one hand.

A guide groove 206 is disposed in an upper portion of the cartridge 200 for exchanging the old and new developers and is engaged with the guide rail 103. A guide hole 207 is disposed in a side portion of the cartridge 200 and the above guide pin 104 is inserted into this guide hole 207. The guide rail 103 is engaged with the guide groove 206 and the guide pin 104 is inserted into the guide hole 207 so that the cartridge 200 can be accurately attached to the cylindrically projected portion 500*b* with no error with respect to the upper and lower sides of the cartridge. Further, when the shutter member 100 on the side of the developing container and the shutter member 204 on the cartridge side are rotated, no cartridge 200 is rotated together with the rotations of the shutter members 100 and 204. A sensor may be disposed in the guide rail 103 or the guide pin 104 so as to detect whether or not the cartridge 200 is reliably set in the cylindrically projected portion 500*b*.

As shown in FIG. 25, fluidity of the developer is 100% when an inclination angle $\alpha$ of the inner wall 208 of the unused developer storage room 201 rising from the opening 203*a* is set to be equal to or greater than 25° with respect to a horizontal line provided when the cartridge 200 is arranged in a normal setting state. When this inclination angle is less than 25°, it is impossible to drop a required amount of developer within the unused developer storage room 201 on the side of the cylindrically projected portion 500*b*. When the inclination angle $\alpha$ of the inner wall 208 is set to be equal to or greater than 25°, the developer smoothly drops into the cylindrically projected portion 500*b*. However, when the inclination angle $\alpha$ is set to be equal to or greater than 25°, the amount of the developer within the unused developer storage room 201 is reduced. An allowable upper limit value of this inclination angle is 90°. It is desirable to set the inclination angle $\alpha$ of the inner wall from 25° to 30° in consideration of the size of the unused developer storage room and the fluidity of the developer.

The motor 101 rotates the shutter member 100 on the side of the developing container and the shutter member 204 on the cartridge side and controls the rotations of these shutter members.

When the old and new developer are exchanged, a user opens a front cover of an unillustrated copying machine to collect a deteriorated developer stored within the developing container 500. Then, the user takes the cartridge 200 for exchanging the old and new developers out of an unillustrated casing of the copying machine. The guide rail 103 and the guide pin 104 are respectively guided and fitted into the guide groove 206 and the guide hole 207 in this cartridge such that the unused developer storage room 201 is located above the cylindrical upper portion 500*b*. At this time, the gear 204*b* is engaged with the gear 102. The relation in position between the opening 100*a* of the shutter member 100 on the side of the developing container and the opening 204*a* of the shutter member 204 on the cartridge side is determined on the basis of the relation in position between the pin 100*c* and the small hole 204*c*. After the cartridge 200 is completely attached to the developing container and an unillustrated switch for exchanging the old and new developers is turned on, the motor 101 is turned on and the gear 102 is rotated. Thus, the gears 100*b* and 204*b* engaged with the gear 102 are rotated and the shutter member 204 on the side of the developing container and the shutter member 100 on the cartridge side are simultaneously rotated. The shutter members 204 and 100 are rotated until the second opening 500*d*, the third opening 100*a*, the fourth opening 204*a* and the sixth opening 203*b* are aligned with each other. Then, the rotation of the motor 101 is stopped. Thereafter, when the blade wheel 4 and the screw conveyer 700 are rotated, the deteriorated developer within the developing container 500 is conveyed by the action of the spiral wire 600 toward the second opening 500*d* from the cylindrically projected portion 500*b*. The deteriorated developer is then collected within the developer collecting room 202 of the cartridge 200 through the third opening 100*a*, the fourth opening 204*a* and the sixth opening 203*b*.

When the motor 101 is next rotated again, the rotary gear 102 is rotated and the gears 100*b* and 204*b* engaged with the gear 102 are rotated. Thus, the shutter member 100 on the side of the developing container and the shutter member 204 on the cartridge side are simultaneously rotated. Both the shutter members 100 and 204 are rotated until the first opening 500*c*, the third opening 100*a*, the fourth opening 204*a* and the fifth opening 203*a* are aligned with each other. A new developer is supplied form the unused developer storage room 201 into the cylindrically projected portion 500*b* through the fifth opening 203*a*, the fourth opening 204*a*, the third opening 100*a* and the first opening 500*c*, thereby completing the exchanging operation of the old and new developers. When the exchanging operation of the developers has been completed, the motor 101 is operated and the rotary gear 102 is rotated. Thus, the gears 100*b* and 204*b* engaged with the gear 102 are rotated so that the shutter member 100 on the side of the developing container and the shutter member 204 on the cartridge side are simultaneously rotated. The third and fourth openings 100*a* and 204*a* are thus moved to their closing positions, thereby preventing the developer from being leaked from these openings.

The developing container side shutter member 100 and the cartridge side shutter member 204 are rotated and accurately stopped in positions in which the exchanging operation with respect to the next new developer is easily performed. When the old and new developers have been completely exchanged, a buzzer, a display, an announcement, etc. inform a user of the completion of the exchanging operation of the developers. When the user knows the completion of the exchanging operation of the developers, the user grasps the cartridge 200 in his one hand and pulls it out of the cylindrically projected portion 500*b* and throws away this cartridge 200 including the used developer.

In accordance with this embodiment, the old and new developers are exchanged by attaching the developer cartridge onto the body side of the developing apparatus and operating the above shutter members.

The new developer is supplied and the old developer is collected by the control means little by little. Accordingly, no old and new developers are unbalanced in comparison with the case in which the new developer is supplied into the body of the developing apparatus at one time.

Further, the old and new developers are exchanged during the stoppage of the copying operation in the image forming apparatus, i.e., after the completion of the copying operation. Accordingly, there is no wasting time caused by interruption of the copying operation.

Further, the old and new developers are exchanged every predetermined number of image forming operations so that it is possible to efficiently exchange the old and new developers in accordance with the deterioration of the developer depending on the number of image forming operations.

Further, since the volume of the second developer storage room is larger than that of the first developer storage room, it is possible to prevent the collected developer from overflowing from the second developer storage room in advance.

As mentioned above, in accordance with the present invention, a user can exchange the old and new developers simply and reliably and it is also possible to prevent the developers from being leaked.

Since the old and new developers are gradually exchanged, it is possible to prevent an irregular density of an image caused by an unbalance of the old and new developers in advance.

Further, there is no wasting time caused by interruption of the copying operation.

Since the used developer can be automatically collected, it is possible to reduce a time for collecting the used developer in comparison with that in the case in which the used developer is collected after a new developer cartridge is set.

Further, since the volume of the second developer storage room is larger than that of the first developer storage room, it is possible to prevent the collected developer from overflowing from the second developer storage room in advance when the used developer is collected.

Many widely different embodiments of the present invention may be constructed without departing from the spirit and scope of the present invention. It should be understood that the present invention is not limited to the specific embodiments described in the specification, except as defined in the appended claims.

What is claimed is:

1. A cartridge for exchanging developers comprising:

an unused developer storage room disposed in an upper portion of the cartridge and storing an unused developer;

a developer collecting room disposed in a lower portion of the cartridge and storing a used developer;

a cylindrical inner wall disposed between the developer storage room and the developer collecting room and having developer receiving and collecting openings respectively connected to the developer storage room and the developer collecting room; and a cartridge side shutter member partially having an opening rotatably fitted onto an inner side of said inner wall and selectively corresponding to said developer receiving and collecting openings, said cartridge side shutter member rotatably connected to a shutter member on the side of a developing container.

2. A developing apparatus comprising:

a developer cartridge having a fist developer storage room for storing an unused developer, a second developer storage room for storing a used developer withdrawn from the developing apparatus, and shutter members for opening and closing openings of the first and second developer storage rooms; and means for detachably attaching the developer cartridge to a developer exchanging section for exchanging the used developer for the unused developer on a body side of the developing apparatus.

3. A developing apparatus as claimed in claim 2, wherein said second developer storage room is adapted to store all of the used developer within the developing apparatus.

4. A developing apparatus as claimed in claim 2, wherein said developer exchanging section has openings disposed respectively opposite to said openings of the first and second developer storage rooms.

5. A developing apparats as claimed in claim 4, wherein said developer exchanging section comprises shutters disposed respectively on said openings of the developer exchanging section.

6. A developing apparatus as claimed in claim 5, wherein said openings of the developer exchanging section is constructed so as not to be opened simultaneously.

7. A developing apparatus as claimed in claim 5, wherein said openings of the developer exchanging section is constructed so that only one of said openings of the developer exchanging section is selectively opened.

8. A developing apparatus as claimed in claim 2, which further comprises a driving means for driving the shutter of the developer cartridge.

9. A developing apparatus as claimed in claim 8, which further comprises a control means for controlling said driving means so as to open the first developer storage room after opening the second developer storage room.

10. A developing apparatus as claimed in claim 9, wherein said controlling of the control means is carried out during a stoppage of a copying operation.

11. A developing apparatus as claimed in claim 9, wherein said controlling of the control means is carried out every predetermined number of image forming operations.

12. A developing apparatus comprising:

a developer cartridge having a first developer storage room for storing an unused developer, a second developer storage room for storing a used developer withdrawn from the developing apparatus, and shutter members for opening and closing openings of the first and second developer storage rooms; and means for detachably attaching the developer cartridge to a developer exchanging section for exchanging the used developer for the unused developer on a body side of the developing apparatus, said developer cartridge being attached to the body of the developing apparatus at any time, and the used developer being collected within the second developer storage room by operating the developer cartridge by a control signal from the body side of the developing apparatus when life of the developer in use is completed.

13. A developing apparatus comprising:

a developer cartridge having a first developer storage room for storing an unused developer, a second developer storage room for storing a used developer withdrawn from the developing apparatus, and shutter members for opening and closing openings of the first and second developer storage rooms; and means for detachably attaching the developer cartridge to a developer exchanging section for exchanging the used developer for the unused developer on a body side of the developing apparatus, a storable volume of the second developer storage room being larger than that of the first developer storage room.

14. A developing apparatus comprising:

a developer cartridge having a first developer storage room for storing an unused developer, a second developer storage room for storing a used developer withdrawn from the developing apparatus, and shutter members for opening and closing openings of the first and second developer storage rooms; and means for detachably attaching the developer cartridge to a developer exchanging section for exchanging the used developer for the unused developer on a body side of the developing apparatus, the unused and used developers are exchanged when there is no developer within a developing container.

15. A developing apparatus as claimed in claim 14, wherein the unused and used developers are exchanged when there is a developer within a developing container.

16. A developing apparatus comprising:

a developer cartridge having a first developer storage room for storing an unused developer, a second developer storage room for storing a used developer withdrawn from the developing apparatus, and shutter members for opening and closing openings of the first and second developer storage rooms; and means for detachably attaching the developer cartridge to a developer exchanging section for exchanging the used developer for the unused developer on a body side of the developing apparatus, said developer cartridge including a cylindrical inner wall disposed between the first and second developer storage rooms and having developer receiving and collecting openings respectively connected to the first and second developer storage rooms, and said shutter members being constructed by a shutter member on the side of a developing container and a shutter member on a cartridge side, the cartridge side shutter member partially rotatably fitted onto an inner side of said cylindrical inner wall and having an opening selectively corresponding to said developer receiving and collecting openings and being fitted to a cylindrically projected bottom portion of the developing container through the developing container side shutter member and being rotatably connected to the developing container side shutter member.

17. A developing apparatus comprising:

a developer cartridge having a first developer storage room for storing an unused developer, a second developer storage room for storing a used developer withdrawn from the developing apparatus, and shutter members for opening and closing openings of the first and second developer storage rooms; and means for detachably attaching the developer cartridge to a developer exchanging section for exchanging the used developer for the unused developer on a body side of the developing apparatus, the unused and used developers are exchanged irrespective of the storage of a developer within a developing container.

18. A cartridge for exchanging developers comprising:

a first developer storage room for storing an unused developer;

a second developer storage room for storing a used developer;

openings disposed respectively on the first and second developer storage rooms; and shutters disposed respectively on the openings.

19. A cartridge as claimed in claim 18, wherein said shutters are constructed so as not to be opened simultaneously.

20. A cartridge as claimed in claim 18, wherein said shutters are constructed so that only one of said shutters is selectively opened.

21. A cartridge as claimed in claim 18, wherein said shutters comprises an engaging means for engaging with a shutter driving means of a developing apparatus.

22. A cartridge for exchanging developers comprising:

a first developer storage room for storing an unused developer;

a second developer storage room for storing a used developer;

a volume of the second developer storage room is larger than a volume of the first developer storage room.

openings disposed respectively on the first and second developer storage rooms; and shutters disposed respectively on said openings.

* * * * *